United States Patent [19]

Eisenegger

[11] Patent Number: 4,586,658

[45] Date of Patent: May 6, 1986

[54] IMPACT GRINDING METHOD AND APPARATUS

[76] Inventor: Edwin Eisenegger, Neugasse 19, CH-9242 Oberuzwil, Switzerland

[21] Appl. No.: 658,443

[22] Filed: Oct. 5, 1984

Related U.S. Application Data

[63] Continuation of Ser. No. 327,080, Dec. 3, 1981, abandoned.

[30] Foreign Application Priority Data

Dec. 8, 1980 [DE] Fed. Rep. of Germany ..... 3046173
Sep. 25, 1981 [DE] Fed. Rep. of Germany ..... 3138259

[51] Int. Cl.[4] ..... B02L 23/08; B02L 23/18

[52] U.S. Cl. ..... 241/19; 241/24; 241/61; 241/74; 241/80; 241/81; 241/97

[58] Field of Search ..... 241/19, 24, 53, 58, 241/61, 73, 74, 76, 77, 80, 81, 97

[56] References Cited

U.S. PATENT DOCUMENTS 3,078,050 2/1963 Hardinage ..... 241/80 X
3,106,523 10/1963 Couture ..... 241/81 X
4,339,085 7/1982 Williams ..... 241/81 X

*Primary Examiner*—Howard N. Goldberg
*Assistant Examiner*—Timothy V. Eley
*Attorney, Agent, or Firm*—Hubbard, Thurman, Turner & Tucker

[57] ABSTRACT

For impact grinding a free-flowing feed material to a finished product of a narrow grain size range, particularly in the cereal and feeding stuff grinding industry, the feed material is fed to an impact or hammer mill (1) having a sieve jacket (33), wherein it is subjected to a first impact grinding phase, during which a first finished product passes through the sieve jacket (33), while a recirculation material component is withdrawn from the grinding chamber (34) through exhaust means (51) provided on the sieve jacket (33), said recirculation material component being fed to a grain size separator means (4) comprising a sieve screen (44) for separating further finished product from an oversize component which is to be returned to the impact grinding phase, preferably together with newly introduced feed material.

26 Claims, 5 Drawing Figures

IMPACT GRINDING METHOD AND APPARATUS

Figure 1:
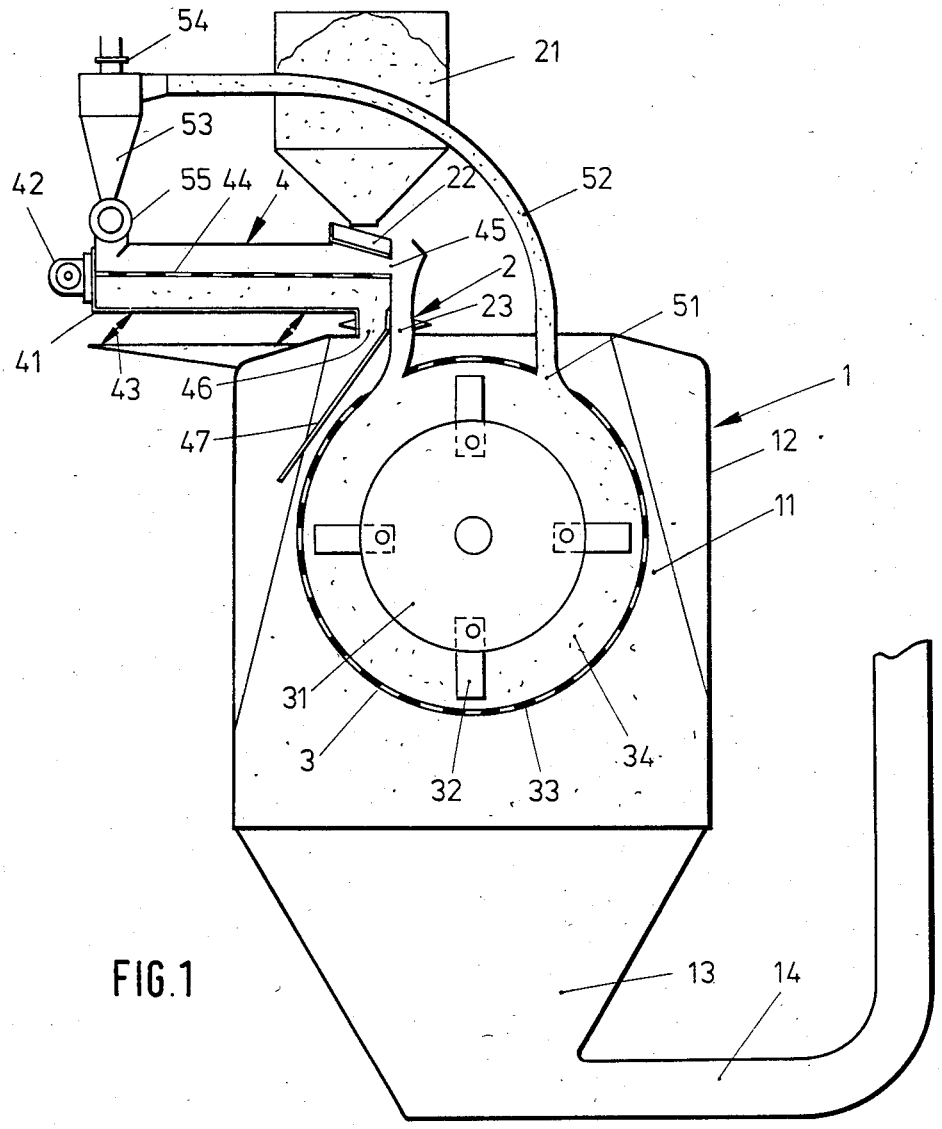

This application is a continuation of application Ser. No. 327,080, filed Dec. 3, 1981, now abandoned.

This invention relates to an impact grinding method of the type wherein a portion of the material is withdrawn from the grinding process and subjected to a separation process, and to an impact grinding plant for carrying out the method.

In prior art impact grinding method employing a hammer, impact or centrifugal mill the material ground in a single or in consecutive grinding steps is subjected to winnowing process for separating therefrom the fraction which is heavier than a predetermined limit weight, which is then returned to a further milling or grinding process, preferably together with newly introduced feed material.

In another prior art impact grinding method employing a hammer, impact or centrifugal mill comprising grinding tools such as impact flails or grinding hammers rotating within a sieve jacket, the finished product lying within a desired grain size range, which has passed through the sieve jacket, is mechanically or pneumatically discharged, while the fraction of insufficiently ground material remaining in the grinding chamber within the sieve jacket after a first grinding phase is removed from the grinding chamber and returned by mechanical means to a further grinding phase, together with newly introduced feed material.

Both of these grinding methods for producing a ground final product within the narrowest possible grain size range suffer from the defect that an overly large fraction of the feed material ground to the grain size of the finished product remains intermingled with the oversize grain fraction removed from the first grinding phase for return to further grinding phases. The subsequent grinding phases are thus needlessly burdened with already sufficiently ground material, so that the overall efficiency is decreased irrespective of overdimensioning of parts of the installation.

It is an object of the invention to improve a method of producing granular material in such a manner that the overall efficiency with regard to the production of a final product within a predetermined grain size range is improved, at the same time reducing the fraction of fines the grain size of which is substantially smaller than that dictated by the sieve jacket, and to provide an impact grinding plant for carrying out the method.

In an impact grinding method of the type indicated above, this object is attained by the characteristics set forth in the appended claims.

The invention is particularly well suited for employ in the grain and feed stuff grinding industry, the raw materials of which are unhomogenous and of varying density, and the finished products of which are of varying specific gravity. These properties complicate the grain size classification which can generally be accomplished only by sieving.

The method according to the invention is characterized in that prior to the end of an impact grinding phase, i.e. prior to completion of the grinding path and thus prior to the previously introduced feed material again reaching the inlet location, at least a major portion of the feed material which has not passed through the sieve jacket is removed and thus withdrawn from the impact grinding process. This removal of the feed material portion which has not passed through the sieve jacket preferably takes place shortly before reaching the feed material inlet location, so that a major portion of the feed material already ground to the desired grain size is able to pass through the sieve jacket extending substantially along the entire grinding path, while a further portion of the feed material also reduced already to the desired grain size, which has not passed through the sieve jacket, is removed and thus withdrawn from the impact grinding process together with a portion of the feed material not yet reduced to the desired grain size. The thus removed portions of the feed material are subjected to a grain size separation step for separating the finished product fraction from the oversize fraction. The oversize fraction is returned to the impact grinding process together with new feed material, while the finished product fraction recovered in the grain size separation step is discharged together with the finished product which has passed through the sieve jacket.

The withdrawal from the impact grinding phase of the feed material fraction which has not yet passed through the sieve jacket towards the end of the grinding path prevents the finished product which has not either passed through the sieve jacket from being carried on into the next impact grinding phase, whereby the energy requirement of the method according to the invention is considerably reduced and the efficiency of the grinding process is substantially improved, permitting the impact grinding plant for carrying out the method according to the invention to be correspondingly smaller dimensioned.

In accordance with a preferred embodiment of the invention the grain size separation of the feed material fraction withdrawn from the impact grinding process is accomplished by sieving to ensure a simple and reliable separation of the finished product fraction from the oversize fraction.

The employ of oscillating conveyor troughs for the uniform feeding of grinding plants has been found advantageous because of the ability of metering the feed flow offered thereby. In a preferred embodiment of the invention a common oscillating drive source is employed for the grain size separation sieve arrangement and the oscillating feed trough.

In an embodiment of the method, or the installation, respectively, according to the invention, the material which has passed through the sieve jacket is likewise subjected to the grain size separation step and is thus also subjected to verification of the proper grain size, so as to ensure that the finished product recovered from the grain size separation does in fact lie within the predetermined grain size range, which is of particular importance in the case of a fully automatic operation of the plant. If on the other hand the feed material fraction which has passed through the sieve jacket does still contain oversize material, this oversize material will be returned to the feed means via the first outlet of the grain size separator.

A sliding gate provided in the sieve jacket permits feed material to be withdrawn from the grinding chamber in addition to that withdrawn through the discharge or removing means connected to the discharge duct or in case of the removing means being closed by the associated shutter, without such feed material having to pass through the sieve jacket. This permits the grain size to be controlled in accordance with the size of the opening in the sieve jacket which is infinitely adjustable by means of the sliding gate and/or the shutter. The larger the opening cross section of the sieve jacket adjusted by the sliding gate and/or the shutter, the larger is the grain size of the feed material fed to the grain size separator. If on the other hand both the sliding gate and the shutter are closed, the conventional grinding method is carried out, in which solely the material which has passed through the sieve jacket is fed to the grain size separator. In this conventional grinding method, however, the driving power requirements are considerably higher than in the grinding method according to the invention.

Figure 2:
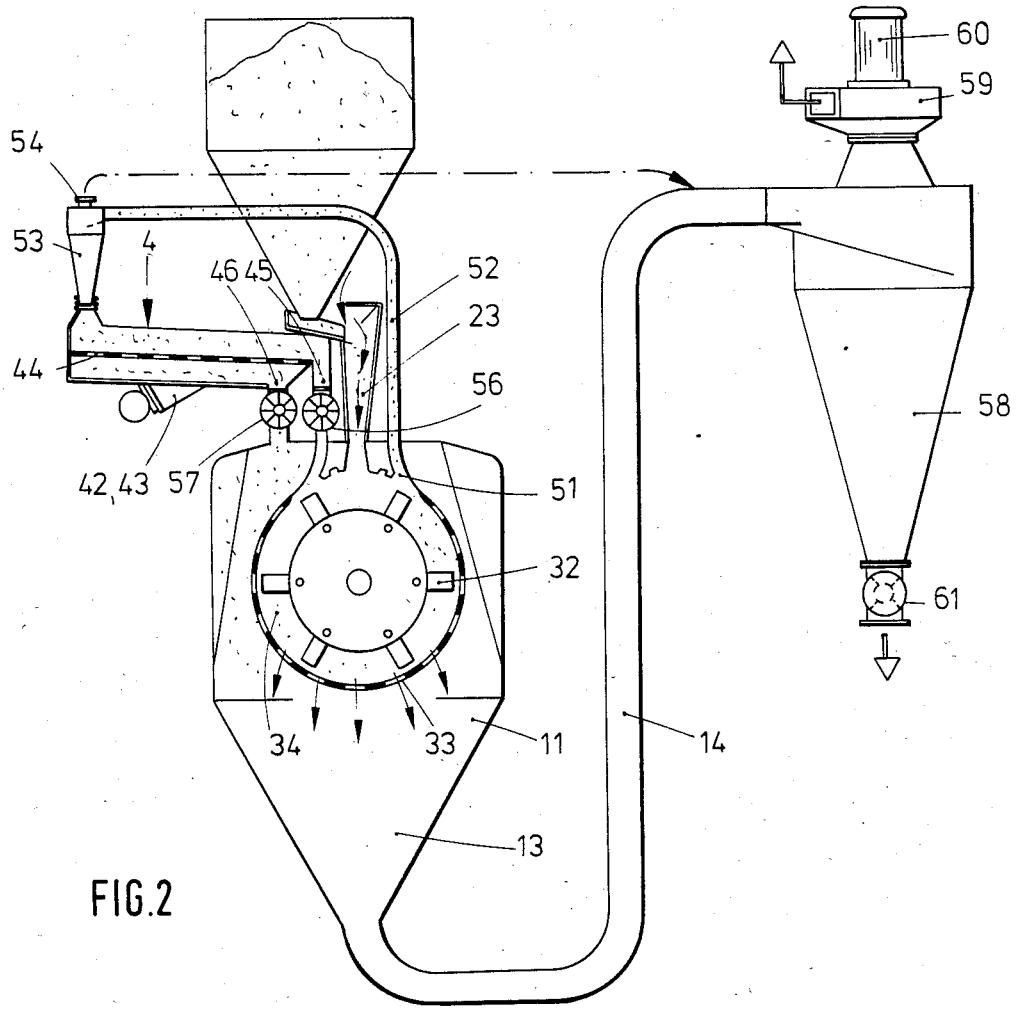
Figure 3:
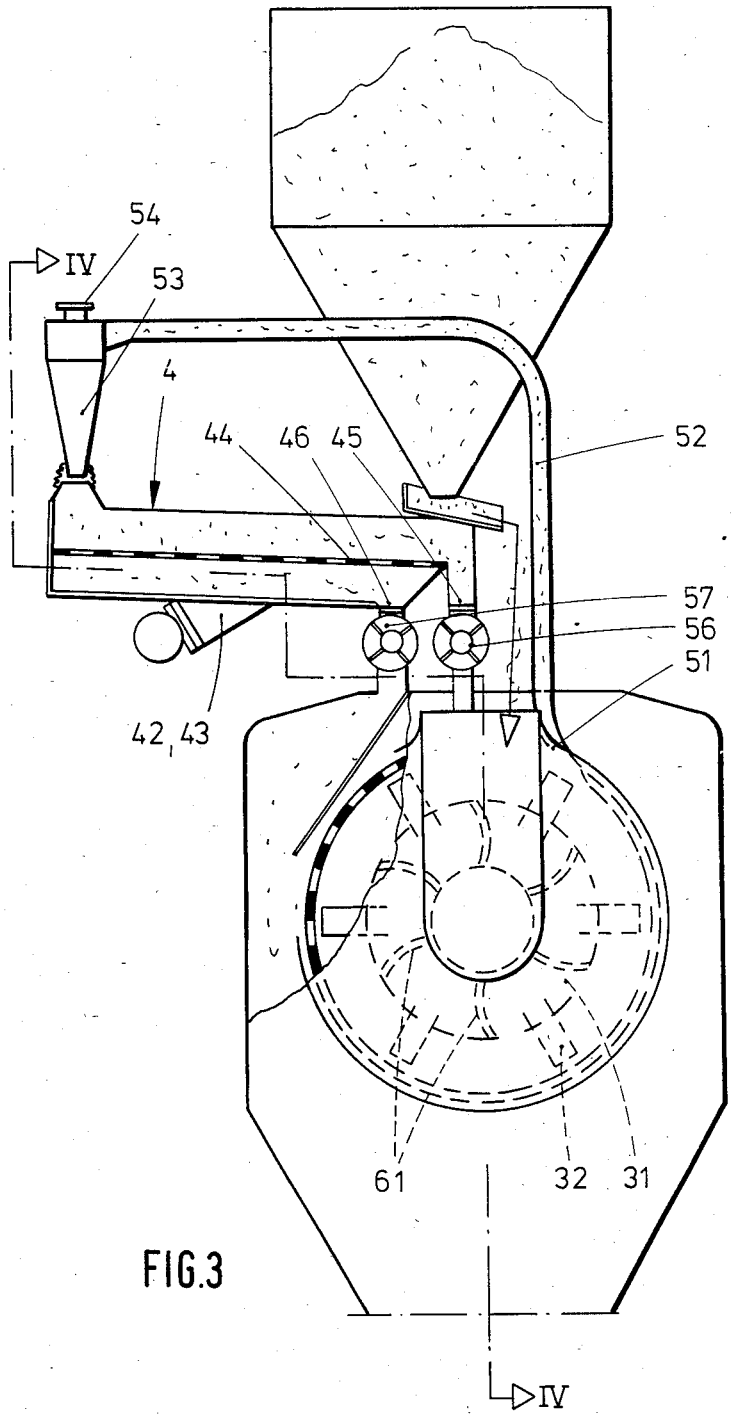
Figure 4:
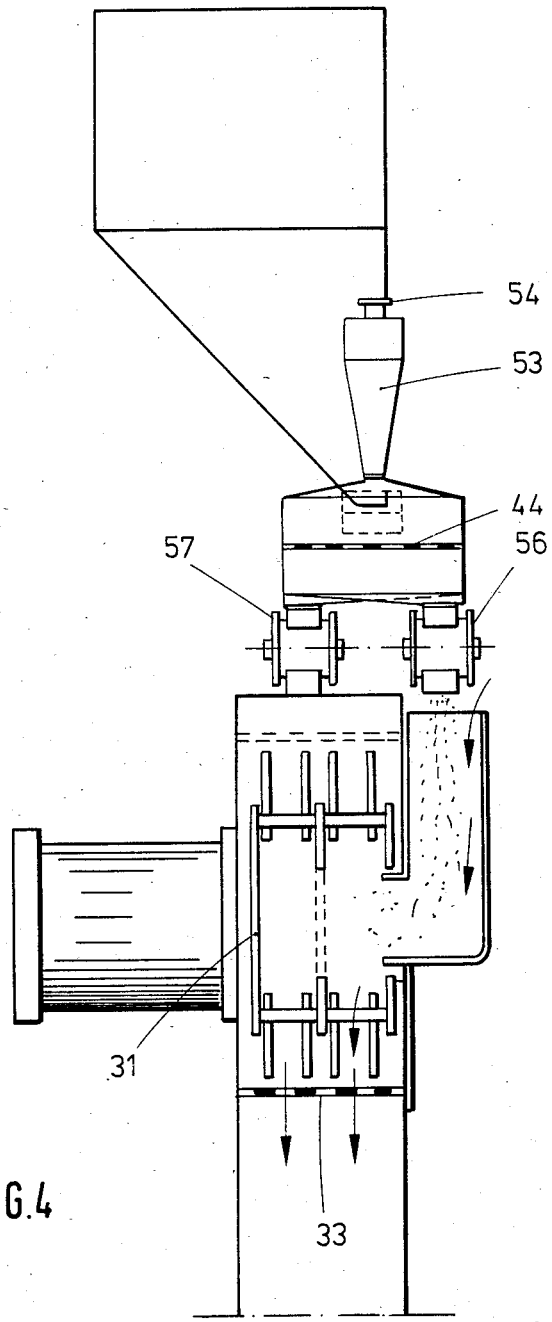
Figure 5:
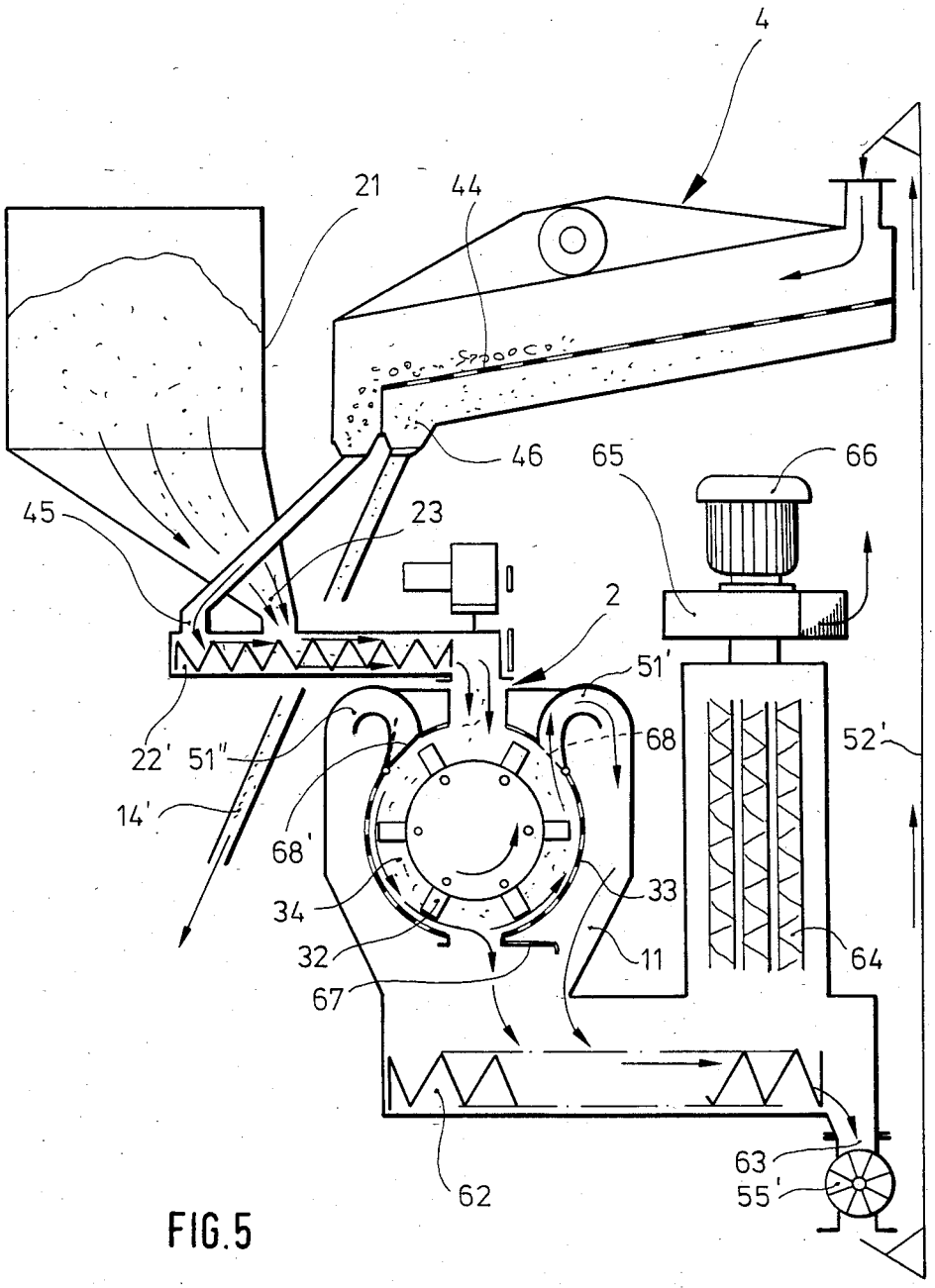

Embodiments of the invention shall now be described with reference to the accompanying drawings, wherein:

FIG. 1 shows a diagrammatical vertical sectional view of a first embodiment of an impact grinding plant for carrying out the method according to the invention, FIG. 2 shows a diagrammatical vertical sectional view of a second embodiment of an impact grinding plant, FIG. 3 shows a diagrammatical vertical sectional view similar to the one shown in FIG. 1 and FIG. 2 of a further embodiment of an impact grinding plant, FIG. 4 shows a sectional view along the line IV—IV in FIG. 3, and FIG. 5 shows a diagrammatical sectional view of a further embodiment of an impact grinding plant for explanation of a modified impact grinding method.

An impact, centrifugal or hammer mill 1 shown in the drawings comprises a finished product collecting chamber 11 within a housing 12, and a discharge arrangement in the form of a mill outlet 13 and a pneumatic conveyor line 14 connected thereto.

Connected to a feed material container or feed hopper 21 is a feed means 2 comprising an oscillating feed trough 22 opening into a feed chute 23.

The feed chute 23 is connected to a grinding unit 3 comprising a mill rotor 31 with impact tools or grinding hammers 32 radially surrounded by a sieve jacket 33 and rotatably mounted within the finished product collecting chamber 11 to be rotated in a per se known manner by a not shown drive motor. The interior space of sieve jacket 33 around impact tools 32 forms a grinding chamber 34 into which feed chute 23 opens.

A grain size separator 4 comprises a sieve housing 41 connected to an oscillating drive unit 42 and supported by oscillating mountings 43. Sieve housing 41 contains a sieve screen 44 of a mesh size selected in accordance with the desired grain size separation. Provided adjacent one end of screen 44 is a reject overflow in the form of a first outlet 45 opening into feed chute 23 of feed means 2, and a second outlet 46 with a guide plate 47 leading from sieve housing 41 to collecting chamber 11.

Oscillating feed trough 22 is connected to sieve housing 41 and thus to common oscillating drive 42. Sieve jacket 33 is formed with exhaust means 51 upstream of the opening of feed chute 23 into grinding chamber 34 in the direction of rotation of the impact tools. A discharge duct 52 connected to exhaust means 51 leads to a cyclone separator 53 itself connected to grain size separator 4 via an air lock, particularly a multiple cell rotary valve 55. An air outlet 54 of cyclone separator 53 and conveyor line 14 may be designed in the known manner as pneumatic conveyor and exhauster systems including blowers and separators. Alternatively, the air flow required to convey the material through discharge duct 52 may be generated by mill rotor 31 or a blower rotor integrally formed therewith or connected thereto, respectively.

From feed hopper 21, metered amounts of the feed material are conveyed via oscillating trough 22 into grinding chamber 34, wherein the material is entrained by the rotating impact tools 32 along sieve jacket 33 towards exhaust means 51, whereby it is subjected to a first grinding phase. This causes finished product produced thereby to pass through sieve jacket 33 into surrounding collecting chamber 11, from where it is discharged through outlet 13 and duct 14.

Upon reaching exhaust means 51, the feed material remaining in grinding chamber 34 enters discharge duct 52 and is pneumatically conveyed to cyclone separator 53, from where it passes through rotary valve 55 into grain size separator 4. The sieve screen 44 is of a mesh size selected in accordance with the predetermined grain size range of the finished product to separate the recirculated material into a finished product component falling through screen 44 and an oversize or recirculation component. As the finished product which has fallen through screen 44 passes through second outlet 46 into collecting chamber 11 to therein join the finished product from the impact grinding phase, the oversize component flows through first outlet 45 into feed means 2 and from there, together with new feed material, into grinding chamber 34 for a further impact grinding phase from the opening of feed chute 23 along sieve jacket 33 towards exhaust means 51. The feed material fed to the impact grinding phase thus consists of new feed material supplied from hopper 21 and oversize material recirculated from grain size separator 4.

The impact grinding method carried out in an impact grinding plant of this type offers the advantage that a major part of the finished product produced during the impact grinding phase passes through the sieve jacket, while the remainder of the finished product entrained by the recirculation material in the grinding chamber is subjected to grain size separation and is thereby separated from insufficiently ground oversize material, so that only a small amount of oversize material is returned to the impact grinding phase. This results in a reduction of the amount of finished product present in the impact grinding phase and thus in an improvement of the efficiency and a reduction of driving power requirement in combination with a reduction of the required sieve screen area and thus the overall size of the grain size separator.

The embodiment of the impact grinding plant shown in FIG. 2 operates in a similar manner as the embodiment shown in FIG. 1, and comprises a further cyclone separator 58 connected to conveyor line 14 for separating the finished product conveyed therealong from the air employed for conveying it. The plant shown in FIG. 2 includes a cyclone separator 58 having an air suction pump or blower 59 which is driven by a motor 60. Below cyclone separator 58 there is provided a multiple-cell rotary valve 61 acting as an air lock for improving the effect of suction blower 59 within conveyor line 14 and collecting chamber 11.

As indicated by phantom lines, air outlet 54 of cyclone separator 53 may also be connected to suction blower 59 in order to assist conveyance of the exhausted material along discharge duct 52.

In the embodiment shown in FIG. 2, the oversize material outlet 45 of grain size separator 4 is connected to grinding chamber 34 independently of feed chute 23. Between oversize material outlet 45 and grinding chamber 34 this separate connection is provided with an air lock 56, preferably also in the form of a multiple-cell rial is withdrawn from the grinding chamber 34 in addition to the material exhausted through opening 51' or 51'', respectively, whereby it is possible to control the grain size of the material fed to grain size separator 4. The larger the opening in sieve jacket 33 uncovered by sliding gate 67, the larger is the grain size of the material fed to grain size separator 4. If a relatively large grain size is desired, sliding gate 67 may be fully opened, in this case, both shutters 68 and 68' may be closed, so that the material which has not passed through sieve jacket 33 is exhausted solely through the opening controlled by sliding gate 67.

In this context it is to be noted that the geometric arrangement of exhaust openings 51' and 51'' as well as of the opening controlled by sliding gate 67 is not restricted to the locations of sieve jacket 33 indicated in the drawing, i.e. the various openings may also be formed at other locations along the grinding path.

If both shutters 68 and 68' as well as sliding gate 67 are closed, the only material removed from the grinding process is the finished product passing through sieve jacket 33, so as to carry out the conventional grinding method, requiring, however, a considerably greater amount of energy and tending to produce a relatively large proportion of fines with a grain size below the predetermined grain size range due to the possibility of repeated circulation of the feed material within the grinding chamber.

In the above described method and apparatus according to the invention, all of the processed material withdrawn from the grinding phase is fed to the grain size separator, so that even the material which has passed through sieve jacket 33 is again subjected to verification of the correct grain size. By this provision it is ensured that the finished product exactly conforms to the desired grain size range even in the case of a fully automatic operation of the impact grinding plant, i.e. without monitoring of the impact grinding process by an operator.

Although the conveyors shown in FIG. 5 are in the form of a metering screw 22', a discharge screw 62 and a bucket elevator 52', the employ of other conveying means such as belt conveyors and the like is obviously possible as required for instance by the lengths of the respective conveying paths.

The grain size control explained above as being effected by means of the slide gate 67 may obviously accomplished also by infinite adjustment of the cross-sectional area of the openings controlled by shutters 68 and 68'.

What I claim is:

1. A method for impact grinding granular material to a finished product of a predetermined relatively narrow grain size range and to prevent the formation of excessive undersize material wherein a first sieve means is provided extending substantially entirely over a grinding path between a material feed station and a material receiving post-feed station, and a second sieve means is provided apart from the grinding path, said method comprising the steps of:

introducing material to be ground to said grinding path and impact grinding said material to grain size in said grain size range and passing at least some of said ground material in said grain size range through said first sieve means;

withdrawing at least part of said material not passed through said first sieve means from said grinding path at a predetermined point on said grinding path without allowing any of said withdrawn material to reenter said grinding path;

introducing all of said withdrawn material to the second sieve means for separating oversize material relative to said grain size range from finer material;

conveying said finer material to said post-feed station without passing through said grinding path; and reintroducing said oversize material to said grinding path to be ground to said grain size range.

2. The grinding method set forth in claim 1 wherein:

said separation process is carried out by passing said withdrawn material through a second sieve means to separate said oversize material from said finer material.

3. The grinding method set forth in claim 1 including the step of:

pneumatically conveying material which has not passed through said first sieve means from said grinding path to a point for carrying out said separation process.

4. The grinding method set forth in claim 3 wherein:

said first sieve means is configured to form an interior grinding chamber into which material is introduced for impact grinding, and pressure air is generated in said grinding chamber for pneumatically conveying said material which has not passed through said first sieve means to a point for carrying out said separation process.

5. The grinding method set forth in claim 1 including the step of:

subjecting said material passed through said first sieve means to said separation process.

6. The grinding method set forth in claim 5 including the steps of:

providing bucket elevator means, and conveying said material which has passed through said first sieve means with said material withdrawn from impact grinding to means for carrying out said separation process.

7. The grinding method set forth in claim 5 including the step of:

withdrawing material from said grinding path at plural predetermined locations along said grinding path.

8. The grinding method set forth in claim 5 including the step of:

metering the amount of material withdrawn from said impact grinding and conveyed to said separation process.

9. Apparatus for impact grinding material to a predetermined grain size range without producing an excessive amount of undersize granular material, said apparatus comprising:

a housing;

sieve means disposed in said housing and comprising a curved sieve jacket defining a grinding chamber, rotating impact tool means disposed in said grinding chamber, feed means for feeding material to said grinding chamber, discharge means for discharging material in said grain size range from said housing, means for withdrawing material which has passed over but not through said sieve means from said grinding chamber including a discharge duct in communication with said grinding chamber at a point along said sieve jacket downstream of the point of introduction of material to said grinding chamber for conducting said withdrawn material away from said grinding chamber without allowrotary valve for pneumatically decoupling the space above sieve screen 44 in grain size separator 4 from the grinding chamber 34.

A further air lock 57, preferably also in the form of a multiple-cell rotary valve, is provided between finished product outlet 46 of grain size separator 4 and collecting chamber 11 for pneumatically decoupling the latter from the space below screen 44 in grain size separator 4.

The vacuum created in collecting space 11 by means of suction blower 59 results in air being drawn thereinto through feed chute 23 and sieve jacket 33, but is prevented from becoming effective within the space below sieve screen 44. The presence of a vacuum in the space below screen 44 of grain size separator 4 might otherwise interfere with the desired grain size separation, as it would result in an air flow from the space above screen 44 to the space therebelow, causing the openings of the screen to be clogged by the oversize material. The occurrence of this phenomenon is reliably prevented by pneumatically decoupling the grain size separator 4 from grinding chamber 34 as well as from collecting chamber 11.

On the other hand there is maintained an air flow from grinding chamber 34 through sieve jacket 33 into collecting chamber 11. This air flow does not, however, interfere with the passage of the finished product through the sieve jacket by causing the openings thereof to become clogged, as the feed material is kept in continuous motion along the interior face of sieve jacket 33 by the impact tools 32 rotating therewithin.

In the embodiment of the impact grinding plant shown in FIGS. 3 and 4, the grinding rotor 31 is formed as, or connected to, respectively, a blower rotor diagrammatically indicated by blower vanes 61. Also in this embodiment, the oversize material outlet 45 and the finished product outlet 46 are pneumatically decoupled or isolated from grinding chamber 34 and collecting chamber 11 by means of air locks 56 and 57, respectively.

In this embodiment, the new feed material as well as the oversize material recirculated from first outlet 45 of grain size separator 4 is introduced centrally of the sieve jacket through an end wall thereof, as particularly shown in FIG. 4. This embodiment permits the effective length of sieve jacket 33 to be increased, as it is solely interrupted by exhaust means 51.

The operation of this embodiment differs from that of the embodiment shown in FIG. 2 only in that an additional suction blower 59 is not required, as the air flow required for recirculation of the material withdrawn from the grinding process through exhaust means 51 as well as for discharging the finished product collected in collecting chamber 11 is generated by the blower rotor integrated with or connected to mill rotor 31.

The remaining operation corresponds to that of the embodiments shown in FIGS. 1 and 2.

A further embodiment of the invention shall now be explained with reference to FIG. 5, wherein parts corresponding to those of the embodiments shown in FIGS. 1 to 4 are designated with the same reference numerals or primed numerals, respectively. From a feed hopper 21 the material to be ground flows through a feed chute 23 to a metering auger 22' of a feed arrangement 2 effective to introduce the material into a grinding chamber 34 formed within a sieve jacket 33. Impact tools 32 mounted within sieve jacket 33 may be selectively rotated clockwise or counterclockwise. On both sides of an inlet opening, sieve jacket 33 is provided with exhaust openings 51' and 51'', respectively, which may be selectively opened or closed by means of shutters 68 and 68', respectively, so that no more than one exhaust opening is open at any time for withdrawing material from the grinding chamber. At its lower portion, sieve jacket 33 is provided with an opening adapted to be opened or closed by means of a sliding gate 67 for permitting further material to be withdrawn from grinding chamber 34. Exhaust openings 51', 51'' as well as the additional opening controlled by sliding gate 67 open into a space 11 surrounding sieve jacket 33 and also receiving the finished product passing through the sieve jacket. A discharge auger 62 connected to space 11 conveys the material collected in space 11 to a third outlet 63 from where the material passes through an air lock 55' to a bucket elevator 52' operative to recirculate the material.

Bucket elevator 52' feeds the mixed material to a grain size separator 4 which may be of the same design as described with reference to FIGS. 1 to 4. Grain size separator 4 has a first outlet 45 for the oversize material which has not passed through sieve screen 44, and a second outlet 46 for the finished product which has passed through the screen and has thus a grain size within the predetermined range. First outlet 45 is connected to metering screw 22' for returning the oversize material to the feed arrangement 2. Second outlet 46 is connected to a diagrammatically shown conveyor line 14' for discharge of the finished product.

Through a filter 64 space 11 and a housing surrounding discharge screw 62 are connected to a suction blower 65 driven by a motor 66. Blower 65 operates to exhaust air from space 11 and thus from the entire grinding plant, which air is replaced by air entering the plant through a lateral air inlet adjacent feeding arrangement 2.

Although not shown in the drawings, feeding arrangement 2 may be arranged to introduce the feed material centrally into the grinding chamber in the direction of the axis of mill motor 31, as shown in detail in FIG. 3, instead of peripherally as shown in FIG. 5.

For carrying out the energy-saving grinding method, one of shutters 68 or 68' is opened as dictated by the direction of rotation of the rotor carrying impact tools 32, the respective other shutter remaining closed, so that the material which has not passed through sieve jacket 33 may be withdrawn from grinding chamber 34 through the respective exhaust opening 51' or 51'' to be collected in space 11. Together with the material which has passed sieve jacket 33, the exhausted material is conveyed by discharge screw 62 from space 11 via third outlet 63 and air lock 55' towards bucket elevator 52' to be fed thereby to grain size separator 4. With the aid of sieve screen 44, grain size separator 4 separates the material fed thereto into the finished product component and an oversize component with the finished product lying within the desired grain size range. While the finished product passes through second outlet towards conveyor line 14', the oversize material which has not passed through sieve screen 44 passes through first outlet 45 towards metering screw 22' the operating speed of which is adapted to be controlled in response to the overall loading of the plant. Together with fresh material supplied from feed hopper 21 via feeding chute 23, the oversize material is fed to feeding arrangement 2 to be introduced into grinding chamber 34.

If in carrying out the method as described above the sliding gate 67 is partially or fully opened, further mateing any of said withdrawn material to reenter said grinding chamber prior to reaching a separator means, said separator means in communication with said discharge duct for receiving all of said material withdrawn from said grinding chamber and for separating oversize material from finer material in said grain size range, said separator means including a first outlet for discharging oversize material to said grinding chamber to be ground to said grain size range and a second outlet for discharging said finer material to said discharge means.

10. The impact grinding apparatus set forth in claim 9 wherein:

said feed means opens centrally into said grinding chamber for introducing said material to said grinding chamber adjacent an end surface of said sieve jacket and in a substantially axial direction with respect to an axis of rotation of said impact tool means.

11. The impact grinding apparatus set forth in claim 9 wherein:

said feed means opend radially into said grinding chamber through said sieve jacket for feeding material to said grinding chamber in a substantially radial direction with respect to an axis of rotation of said impact tool means.

12. The impact grinding apparatus set forth in claim 9 wherein:

said discharge means for material which has passed through said sieve jacket and which has been separated from oversize material in said separator means includes pneumatic conveying means.

13. The impact grinding apparatus set forth in claim 9 wherein:

said apparatus includes a rotor carrying said impact tool means and including blower means for generating pressure air for pneumatic conveying of said material withdrawn from said grinding chamber to said separator means.

14. The impact grinding apparatus set forth in claim 9 wherein:

said separator means includes sieve means and a cyclone separator and said discharge duct opens into said cyclone separator for separating material from conveying air prior to introduction of said material to said sieve means of said separator means.

15. The impact grinding apparatus set forth in claim 14 wherein:

said discharge duct includes conveyor means located between a third outlet and said separator means, said third outlet being adapted to have material which has passed through said sieve jacket as well as material withdrawn from said grinding chamber fed thereto.

16. Apparatus for impact grinding material to a predetermined grain size range without producing an excessive amount of undersize granular material, said apparatus comprising:

a housing;

sieve means disposed in said housing and comprising a curved sieve jacket defining a grinding chamber, rotating impact tool means disposed in said grinding chamber, feed means for feeding material to said grinding chamber, discharge means for discharging material in said grain size range from said housing, means for withdrawing material which has passed over but not through said sieve means from said grinding chamber including a discharge duct in communication with said grinding chamber at a point along said sieve jacket downstream of the point of introduction of material to said grinding chamber;

separator means in communication with said discharge duct for receiving material withdrawn from said grinding chamber and for performing a separation process to separate oversize material from finer material in said grain size range, said separator means including means forming a first outlet for discharging oversize material to said grinding chamber to be ground to said grain size range and means forming a second outlet for discharging said finer material to said discharge means;

a rotor carrying said impact tool means and including blower means for generating pressure air for pneumatic conveying of said material withdrawn from said grinding chamber to said separator means; and means forming an air lock between said first outlet and said grinding chamber and operative to effect pneumatic decoupling therebetween.

17. The impact grinding apparatus set forth in claim 16 wherein:

said apparatus is provided with means forming an air lock between said second outlet and said discharge means operative to effect pneumatic decoupling therebetween.

18. Apparatus for impact grinding material to a predetermined grain size range without producing an excessive amount of undersize granular material, said apparatus comprising:

a housing;

sieve means disposed in said housing and comprising a curved sieve jacket defining a grinding chamber, rotating impact tool means disposed in said grinding chamber, feed means comprising an oscillating conveyor trough for feeding material to said grinding chamber, discharge means for discharging material in said grain size range from said housing, means for withdrawing material which has passed over but not through said sieve means from said grinding chamber including a discharge duct in communication with said grinding chamber at a point along said sieve jacket downstream of the point of introduction of material to said grinding chamber, separator means in communication with said discharge duct for receiving material withdrawn from said grinding chamber and for performing a separation process to separate oversize material from finer material in said grain size range, said separator means including oscillating separator sieve means, means forming a first outlet for discharging oversize material to said grinding chamber to be ground to said grain size range and means forming a second outlet for discharging said finer material to said discharge means, said separator sieve means and said conveyor trough being connected to a common oscillating drive means, and said first outlet is connected to an outlet of said conveyor trough for conducting said oversize material to said grinding chamber.

19. Apparatus for impact grinding material to a predetermined grain size range without producing an excessive amount of undersize granular material, said apparatus comprising:

a housing first sieve means disposed in said housing and comprising a curved sieve jacket defining a grinding chamber, rotating impact tool means disposed in said grinding chamber, feed means for feeding material to said grinding chamber, discharge means for discharging material in said grain size range from said housing, means for withdrawing material which has passed over but not through said sieve means from said grinding chamber including shutter means and a sliding gate in communication with said grinding chamber at a point along said sieve jacket downstream of the point of introduction of material to said grinding chamber for opening said sieve jacket to a variable degree to vary the amount of material withdrawn from said grinding chamber without passing through said sieve jacket;

means defining a space for receiving material which has passed through said sieve means and material withdrawn from said grinding chamber, and separator means in communication with said space for receiving material withdrawn from said grinding chamber and for performing a separation process to separate oversize material from finer material in said grain size range, said separator means including means forming a first outlet for discharging oversize material to said grinding chamber to be ground to said grain size range and means forming a second outlet for discharging said finer material to said discharge means.

20. An apparatus for impact grinding granular material to a finished product of a predetermined relatively narrow grain size range and to prevent the formation of excessive undersize material, said apparatus comprising:

a feed means associated with a feed stations for feeding material to be ground;

a first sieve means having curved sieve jacket defining a grinding chamber connected to the feed means, said first sieve means for passing at least some of ground material in said grain size through said sieve jacket to a discharge means for discharging material in said grain size range from said grinding apparatus;

a rotating impact tool means disposed in said grinding chamber for impact grinding said material to a grain size in the grain size range;

means for withdrawing material from said grinding chamber including a discharge duct in communication with the grinding chamber at a predetermined point in the grinding chamber wherein said impact tool means is interposed between the discharge duct and the feed means, said withdrawal means for withdrawing at least part of said material not passed through said first sieve means from said grinding path at the predetermined point without allowing any of the withdrawn material to reenter the grinding chamber;

conveying means within the discharge duct for conveying the withdrawn material immediately to a separator means;

said separator means for separating oversize material relative to said grain size range from finer material and including a first outlet means for discharging said oversize material to the grinding chamber and including a second outlet means for discharging the finer to the discharge means.

21. The apparatus set forth in claim 20 wherein:

said separator means has an oscillating separator sieve means and said feed means has an oscillating conveyor trough, and wherein said separator sieve means and said conveyor trough are connected to a common oscillating drive means, said first outlet is connected to an outlet of said conveyor trough, and said oversize material is conducted to said grinding chamber from said conveyor trough.

22. The apparatus set forth in claim 20 wherein:

said feed means opens centrally into said grinding chamber and said material is introduced to said grinding chamber adjacent an end surface of said sieve jacket and in a substantially axial direction with respect to an axis of rotation of said impact tool means.

23. The apparatus set forth in claim 20 wherein:

said feed means opens radially into said grinding chamber through said sieve jacket and said material is fed to said grinding chamber in a substantially radial direction with respect to an axis of rotation of said impact tool means.

24. The apparatus set forth in claim 20 wherein:

said discharge duct defines a pneumatic conveyor path leading from said grinding chamber to said separator means, and said material is pneumatically conveyed to said separator means through said discharge duct.

25. The apparatus set forth in claim 20 wherein:

said discharge means for the material which has passed through said sieve jacket and which has been separated from oversize material in said separator means includes pneumatic conveying means and said material which has been separated is pneumatically conveyed to further separation means in communication with said discharge means.

26. The apparatus set forth in claim 20 wherein:

said apparatus includes a grinding rotor carrying said impact tool means and including a blower rotor means for generating pressure air and for conveying said material pneumatically by said air pressure air to said separator means.

* * * * *